US008888502B2

(12) United States Patent
Terhune, IV

(10) Patent No.: US 8,888,502 B2
(45) Date of Patent: Nov. 18, 2014

(54) ELECTRICAL CONNECTOR WITH DUAL CONTACT HALVES

(71) Applicant: Hon Hai Precision Industry Co., Ltd., New Taipei (TW)

(72) Inventor: Albert Harvey Terhune, IV, Chandler, AZ (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 83 days.

(21) Appl. No.: 13/677,300

(22) Filed: Nov. 15, 2012

(65) Prior Publication Data

US 2014/0134882 A1 May 15, 2014

(51) Int. Cl.
*H01R 12/00* (2006.01)
*H01R 12/70* (2011.01)
*H01R 13/24* (2006.01)

(52) U.S. Cl.
CPC ..... *H01R 12/7076* (2013.01); *H01R 13/2407* (2013.01)
USPC ..... 439/66; 439/71

(58) Field of Classification Search
CPC ..... H01R 13/2435; H01R 12/714
USPC ..... 439/66, 71
See application file for complete search history.

(56) References Cited

U.S. PATENT DOCUMENTS 5,653,598 A 8/1997 Grabbe
6,186,797 B1 2/2001 Wang et al.
7,182,605 B2 * 2/2007 Sun et al. ..... 439/66
7,201,584 B1 * 4/2007 Ju et al. ..... 439/71
7,473,104 B1 * 1/2009 Wertz ..... 439/66
7,537,461 B2 * 5/2009 Rathburn ..... 439/66
7,645,164 B1 * 1/2010 Ju ..... 439/591
7,695,286 B2 * 4/2010 Swart et al. ..... 439/66
7,841,864 B2 * 11/2010 Hsiao et al. ..... 439/66
7,862,343 B1 * 1/2011 Lin et al. ..... 439/66
7,891,983 B2 * 2/2011 Ichimura et al. ..... 439/66
7,927,109 B1 * 4/2011 Gattuso ..... 439/66
7,938,649 B2 * 5/2011 Gattuso ..... 439/71
8,210,855 B1 * 7/2012 Lin ..... 439/66
8,435,046 B2 * 5/2013 Gattuso ..... 439/71
8,441,275 B1 * 5/2013 Alladio ..... 324/756.02
8,536,889 B2 * 9/2013 Nelson et al. ..... 324/754.01
8,672,688 B2 * 3/2014 Florence et al. ..... 439/66
2004/0157476 A1 * 8/2004 Maldonado et al. ..... 439/66
2004/0192081 A1 * 9/2004 Koopman et al. ..... 439/66
2005/0037635 A1 * 2/2005 Hsu et al. ..... 439/66
2005/0037641 A1 * 2/2005 Chen et al. ..... 439/71
2005/0227511 A1 * 10/2005 Sun et al. ..... 439/66
2005/0233606 A1 * 10/2005 Liao et al. ..... 439/66
2007/0077785 A1 * 4/2007 Ju et al. ..... 439/66
2009/0075497 A1 * 3/2009 Swart et al. ..... 439/66
2009/0311886 A1 * 12/2009 Hsieh et al. ..... 439/66
2010/0029100 A1 * 2/2010 Ichimura et al. ..... 439/66
2010/0029102 A1 * 2/2010 Chen et al. ..... 439/66
2013/0040472 A1 * 2/2013 Gattuso ..... 439/66

* cited by examiner

*Primary Examiner* — Ross Gushi
(74) *Attorney, Agent, or Firm* — Wei Te Chung; Ming Chieh Chang

(57) ABSTRACT

An electrical connector includes an insulative housing having a plurality of passageways and a number of contacts restricted in the insulative housing. Each contact includes an upper contact half sliding in the passageways and a lower contact half supporting the upper contact half. The upper contact half has three curve sections and the lower contact half has two curve sections. When a force is applied to the upper contact half, the upper and lower contact halves are wiping each other and both are deflectable in vertical and transverse directions.

17 Claims, 11 Drawing Sheets

ELECTRICAL CONNECTOR WITH DUAL CONTACT HALVES

BACKGROUND OF THE INVENTION

1. Field of the Invention

The present invention relates to an electrical connector, and particularly to an electrical connector having improved two-half contacts for electrically connecting an electronic package, such as a land grid array (LGA) central processing unit (CPU), with a circuit substrate, such as a printed circuit board (PCB).

2. Description of Related Art

Connectors for removably mounting an LGA package on a PCB are known as LGA sockets. An LGA socket typically comprises a substantially flat insulative housing, which is positioned between the LGA and the PCB. The housing defines an array of passageways with electrical contacts received therein.

Various contacts for LGA sockets are disclosed in the prior art, such as U.S. Pat. Nos. 5,653,598, 6,186,797. Typically, a contact for an LGA socket comprises a retaining portion for engaging with a housing, a first spring arm inclinedly and upwardly extending from the retaining portion defines a first contacting portion extending beyond the upper surface of the housing for connecting with the LGA package and a second spring arm inclinedly and downwardly extending from the retaining portion defines a second contacting portion extending beyond the bottom surface of the housing for connecting with the PCB. Therefore, an electrical connection is established between the LGA package and the PCB.

The contacts with such inclinedly arranged spring arms can provide good elasticity when compressed by the LGA package. However, such structure of the contact makes the transverse distance, or the pitch, between two contacts along a transverse direction perpendicular to a mating direction between the contacts and the LGA package become too large and cannot be tightly arranged. As the socket is reduced in size and the number of the contacts are increased gradually because of quick development of technology. Improved contacts for an LGA socket with fine pitch and desirable elasticity are required to overcome the disadvantages of the conventional contacts.

An improved electrical connector that overcomes the above-mentioned problems is desired.

BRIEF SUMMARY OF THE INVENTION

An object of the present invention is to provide an electrical connector simplifying the bending process of contacts and providing fine pitch.

An electrical connector comprises an insulative housing having a plurality of passageways extending therethrough and a plurality of contacts restricted in the insulative housing. Each contact includes an upper contact half sliding in the passageways and a lower contact half supporting the upper contact half. Said upper contact half has a first curve section extending out of the insulative housing at a free end thereof, a second curve section extending from the first curve section, and a third curve section at a bottom end thereof. Said lower contact half has a first curve section contacting with the upper contact half, an elastic section connected with the first curve section and a second curve section at bottom end thereof. When a force is applied to the first curve section of the upper contact half, the upper and lower contact halves are deflectable.

An electrical connector comprises an insulative housing having a plurality of passageways extending therethrough and two contact halves coupled with each other and received in each passageway. One contact half includes three curve sections connected end-to-end and the other contact half includes at least two curve sections at two free ends thereof. Said two contact halves are adapted to deflect in vertical and transverse directions and wiping each other when an external force is exerted thereon.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
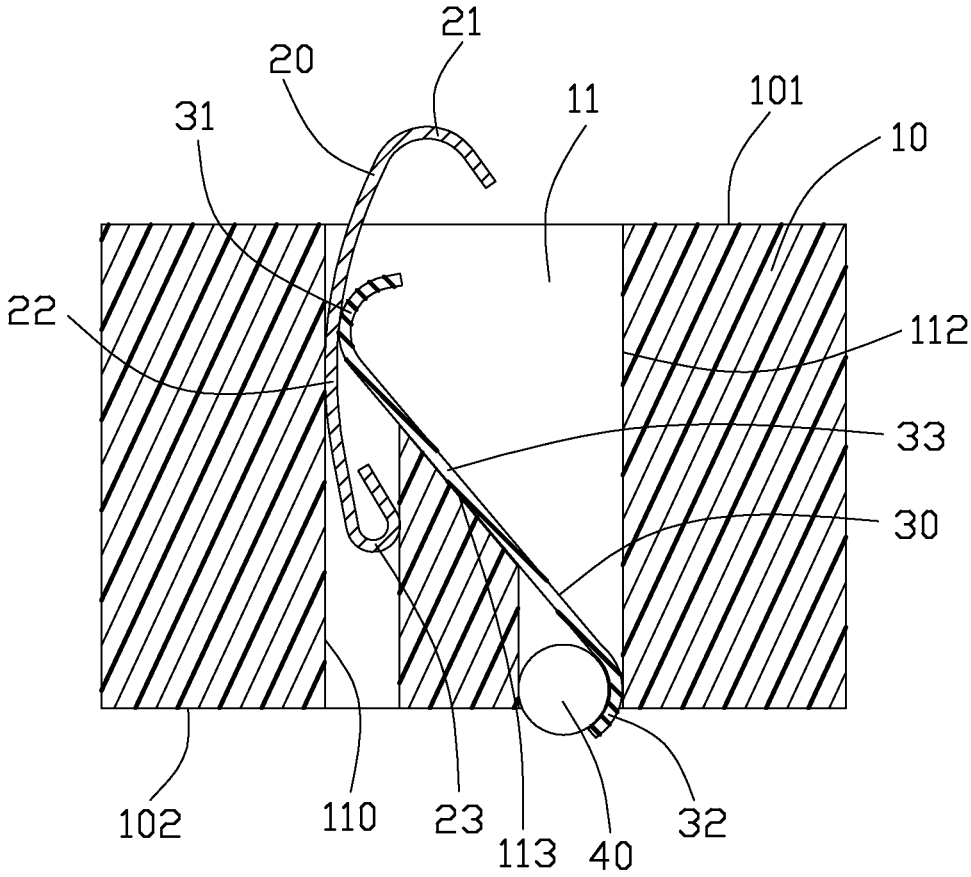
FIG. 1 is a cross-sectional view of an electrical connector showing two contact halves in a free state according to a first embodiment of the present invention.

Reference will be made to the drawing figures to describe the present invention in detail, wherein depicted elements are not necessarily shown to scale and wherein like of similar elements are designated by same or similar reference numeral through the several views and same or similar terminology.

Referring to FIGS. 1-4, an electrical connector in accordance with a preferred embodiment of the present invention is used for electrically connecting an electronic package, such as a land grid array (LGA) central processing unit (CPU, not shown), with a circuit substrate, such as a printed circuit board (PCB, not shown). The electrical connector includes an insulative housing 10 having a plurality of passageways 11 extending therethrough, and a plurality of contacts restricted in the insulative housing 10. Each contact includes an upper contact half 20 sliding in the passageways 11 and a lower contact half 30 supporting the upper contact half 20.

Figure 4:
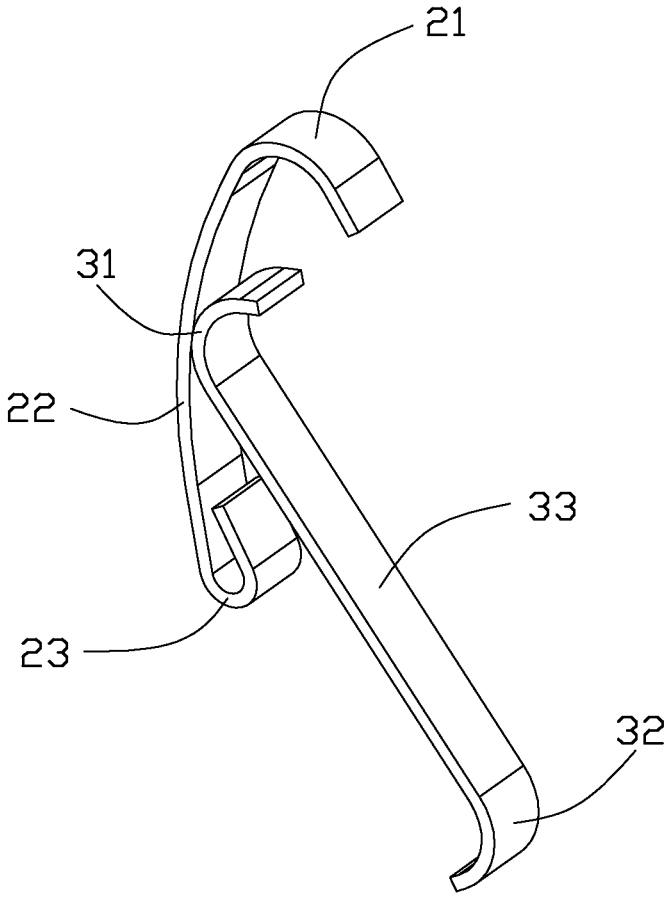
FIG. 4 is a perspective view of the contact halves shown in FIG. 1.

Referring to FIGS. 1 and 4, the upper contact half 20 has a first curve section 21 extending out of a top surface 101 of the insulative housing 10 at a free end thereof, a second curve section 22 extending from the first curve section 21, and a third curve section 23 at a bottom end thereof.

The upper contact half 20 is formed by bending operations, and the first curve section 21, the second curve section 22 and the third curve section 23 are arranged end-to-end. The second curve section 22 of the upper contact half 20 slides along an inner surface 110 of the passageway 11. The second curve section 22 in the middle projects to the inner surface 110 of the passageway 11, and the second and third curve sections 22, 23 at upper and lower ends of the upper contact half 20 bending upwardly and downwardly, respectively and open opposite to each other.

The lower contact half 30 has a first curve section 31 contacting with the upper contact half 20, an elastic section 33 connected with the first curve section 31 and a second curve section 32 at bottom end thereof and extending out of a bottom surface 102 of the insulative housing 10. The lower contact half 30 is formed by bending operations, and the first curve section 31, the elastic section 33 and the second curve section 32 thereof are arranged end-to-end.

Figure 3:
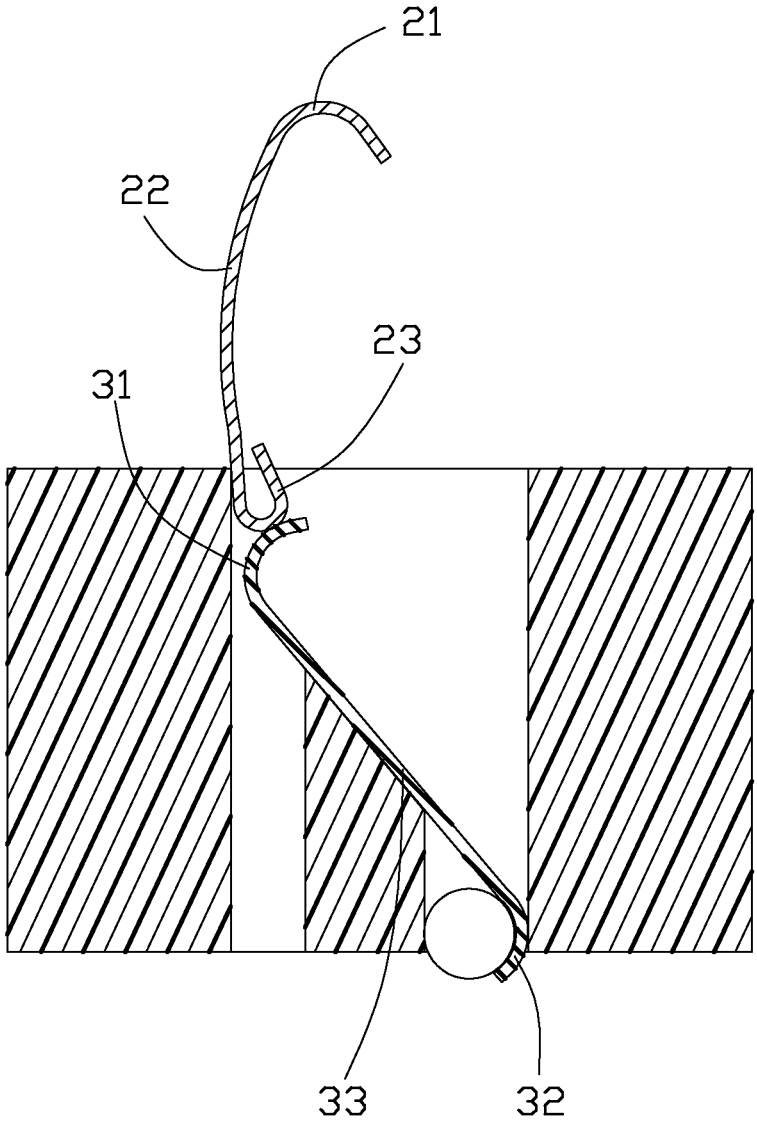
FIG. 3 is a sketch view showing how the contact halves are attached.

As shown in FIGS. 1 and 3, the third curve section 23 of the upper contact half 20 is a closed looped end and the first curve section 31 of the lower contact half 30 is provided with a guiding surface for the third curve section 23 of the upper contact half 20 inserted downwardly and passing thereby. A solder ball 40 is clipped by the second curve section 32 and the insulative housing 10. The insulative housing 10 defines a slant surface 113 under the elastic section 33 to support the elastic section 113 of the lower contact half 30.

Figure 2:
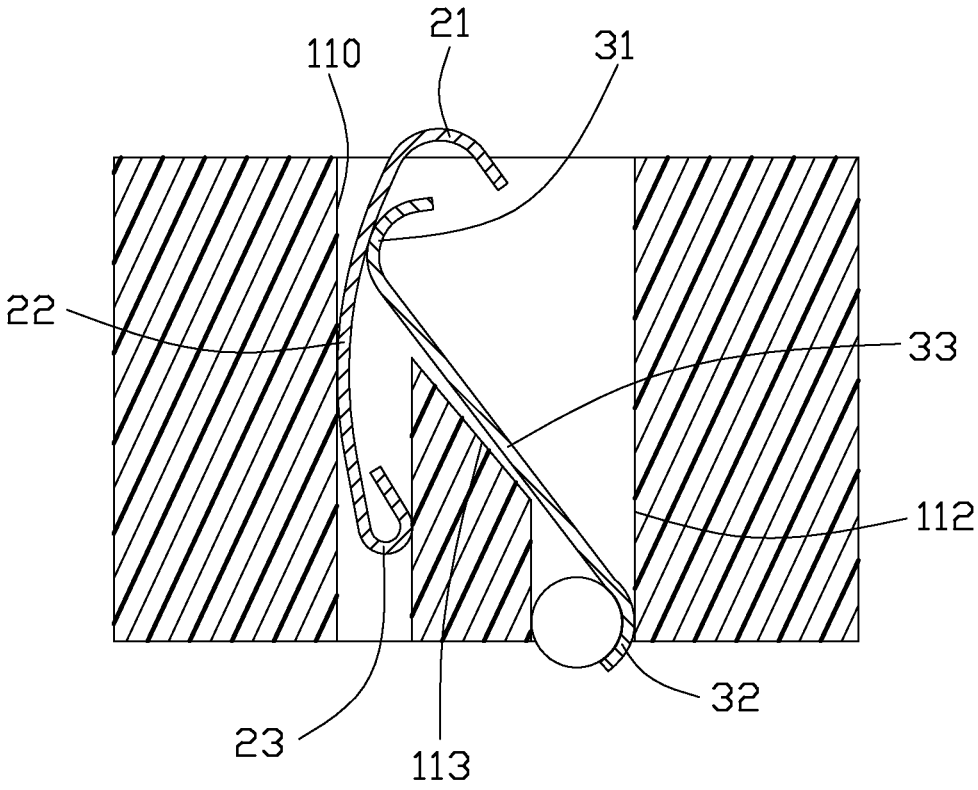
FIG. 2 is another cross-sectional view of the electrical connector shown in FIG. 1 while the contact halves are pressed.

As shown in FIG. 2, as the CPU (not shown) moves downward, an external force is applied to the first curve section 21 of the upper contact half 20. The upper contact half 20 moves downward while maintaining the interface with the lower contact half 30. The lower contact half 30 applies a force on a surface of the second curve section 22 of the upper contact half 20.

The second curve section 22 of the upper contact half 20 is combined with a more rigid material than the first curve section 31 of the lower contact half 30 allows the surface to serve as the interface between both contact halves. As the upper contact half 20 moves downward, it wipes against the lower contact half 30, thus creating a reaction force and causes displacement in the low contact half 30. Therefore, both the upper and lower contact halves 20, 30 are deflectable in vertical and transverse directions.

When inserting the contact into the insulative housing 10, the looped end of the upper contact half 20 forces the first curve section 31 of the lower contact half 30 to displace to allow the looped end to pass by. Once the looped end pass by the first curve section 31, the lower contact half 30 makes contact with the surface of the second curve section 22 of the upper contact half 20. In the same time, the upper contact half 20 is retained from being pulled out.

Figure 5:
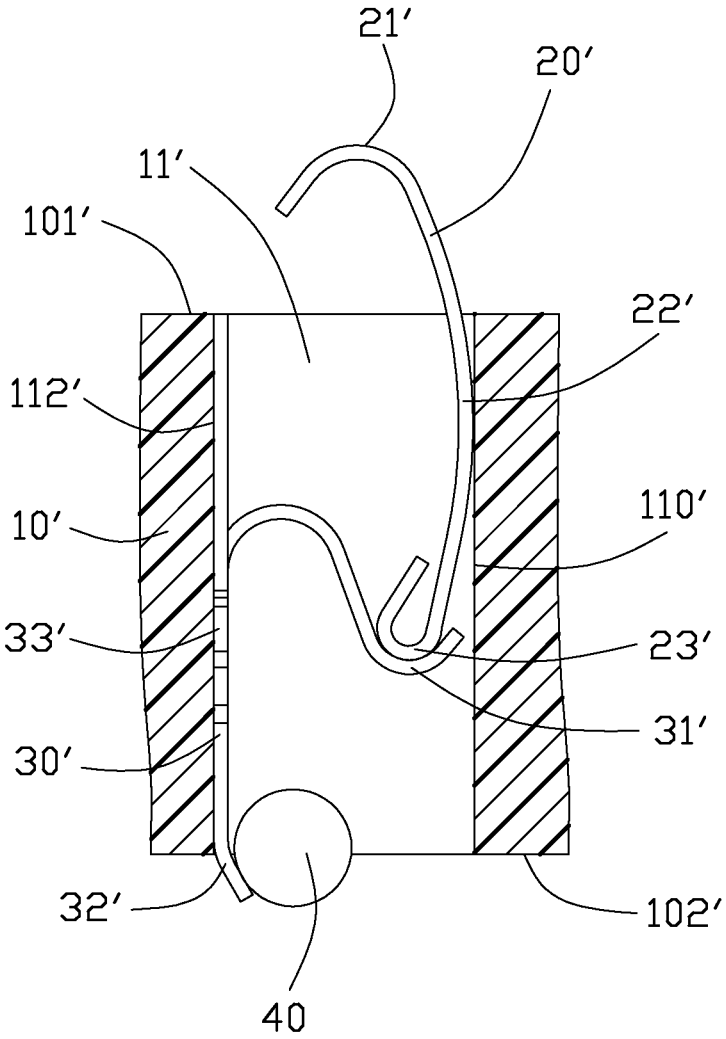
FIG. 5 is a cross-sectional view of an electrical connector showing two contact halves in a free state according to a second embodiment of the present invention.
Figure 6:
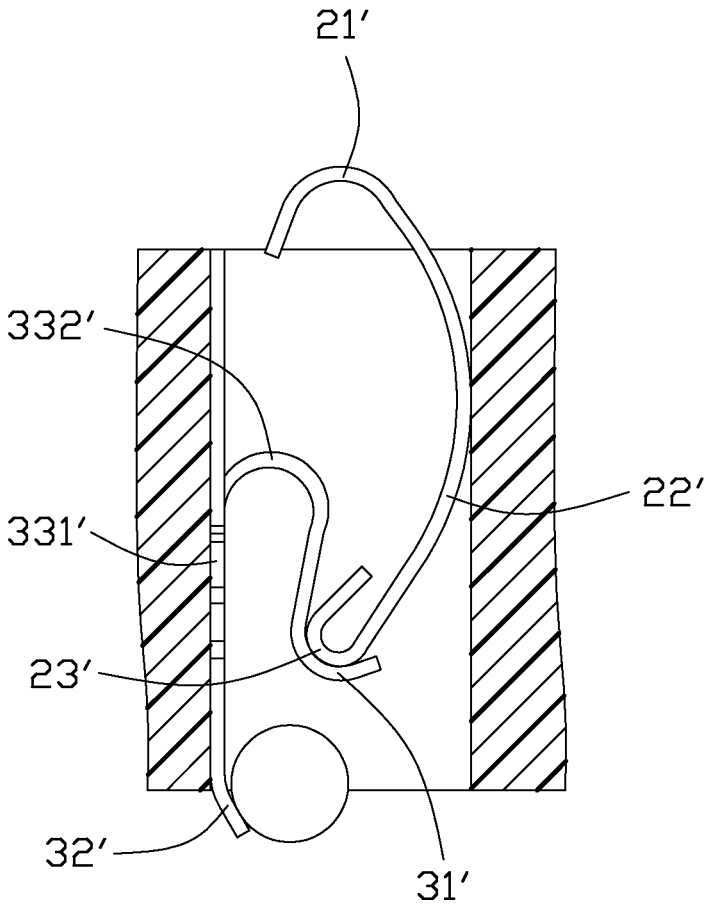
FIG. 6 is another cross-sectional view of the electrical connector shown in FIG. 5 while the contact halves are pressed.
Figure 7:
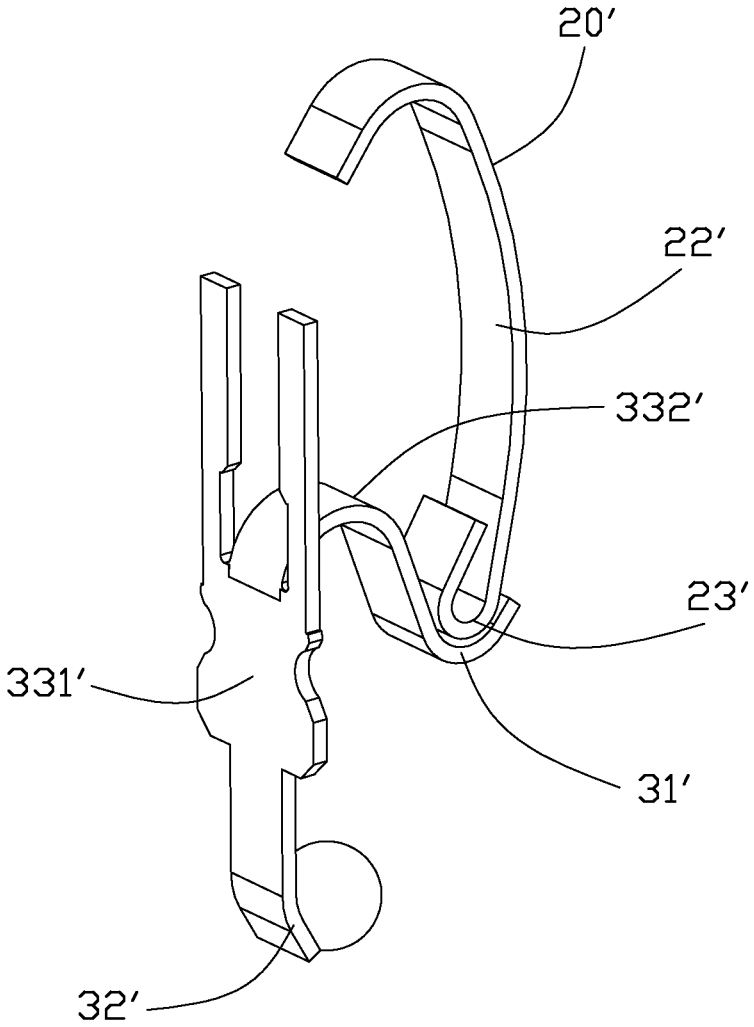
FIG. 7 is a perspective view of the contact halves shown in FIG. 5.

Referring to FIGS. 5-7, an electrical connector in accordance with a second preferred embodiment of the present invention includes an insulative housing 10' having a plurality of passageways 11' extending therethrough, and a plurality of contacts restricted in the insulative housing 10'. Each contact includes an upper contact half 20' sliding in the passageways 11' and a lower contact half 30' supporting the upper contact half 20'.

Referring to FIGS. 5 and 7, the upper contact half 20' has a first curve section 21' extending out of a top surface 101' of the insulative housing 10' at a free end thereof, a second curve section 22' extending from the first curve section 21', and a third curve section 23' at a bottom end thereof. The upper contact half 20' is formed by bending operations, and the first curve section 21', the second curve section 22' and the third curve section 23' are arranged end-to-end. The second curve section 22' of the upper contact half 20' slides along an inner surface 110' of the passageway 11'.

The lower contact half 30' has a first curve section 31' contacting with the upper contact half 20', an elastic section 33' connected with the first curve section 31' and a second curve section 32' at bottom end thereof and extending out of a bottom surface 102' of the insulative housing 10'. The elastic section 33' includes a straight portion 331' contacts with another inner surface 112' of the passageway 11' and a curve 332' connected with the first curve section 31'. The third curve section 23' of the upper contact half 20' is a closed looped end and supported by the first curve section 31' of the lower contact half 30'. A solder ball 40 is clipped by the second curve section 32' of the lower contact half 30' and the insulative housing 10'.

As shown in FIG. 6, as the CPU (not shown) moves downward, an external force is applied to the first curve section 21' of the upper contact half 20', the upper contact half 20' moves downward while maintaining the interface with the lower contact half 30'. The force translates to the lower contact half 30'. Under using, the arc radius of the second curve section 22' becomes smaller as force is applied to the first curve section 21'. Therefore, both the upper and lower contact halves 20', 30' are deflectable in vertical and transverse directions.

The straight portion 331' retention the lower contact half 30' on the insulative housing 10', but can be changed and optimized to suit the needs of the application. The upper contact half 20' can be retained by adding features in the insulative housing to prevent it from falling out. Frictional force between the contact halves allows for an electrical signal path.

Referring to FIGS. 8-11, an electrical connector in accordance with a third preferred embodiment of the present invention includes an insulative housing 10" having a plurality of passageways 11" extending therethrough, and a plurality of contacts restricted in the insulative housing 10". Each contact includes an upper contact half 20" sliding in the passageways 11" and a lower contact half 30" supporting the upper contact half 20".

Figure 8:
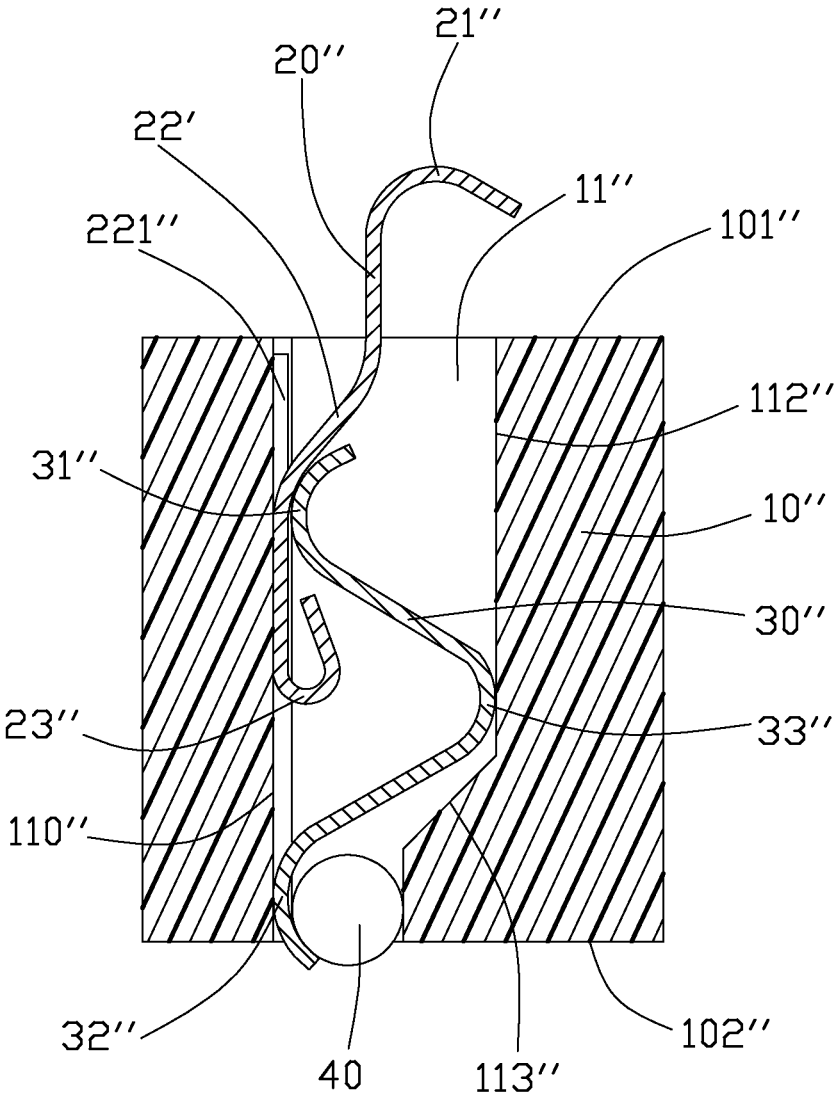
FIG. 8 is a cross-sectional view of an electrical connector showing two contact halves are in a free state according to a third embodiment of the present invention.
Figure 11:
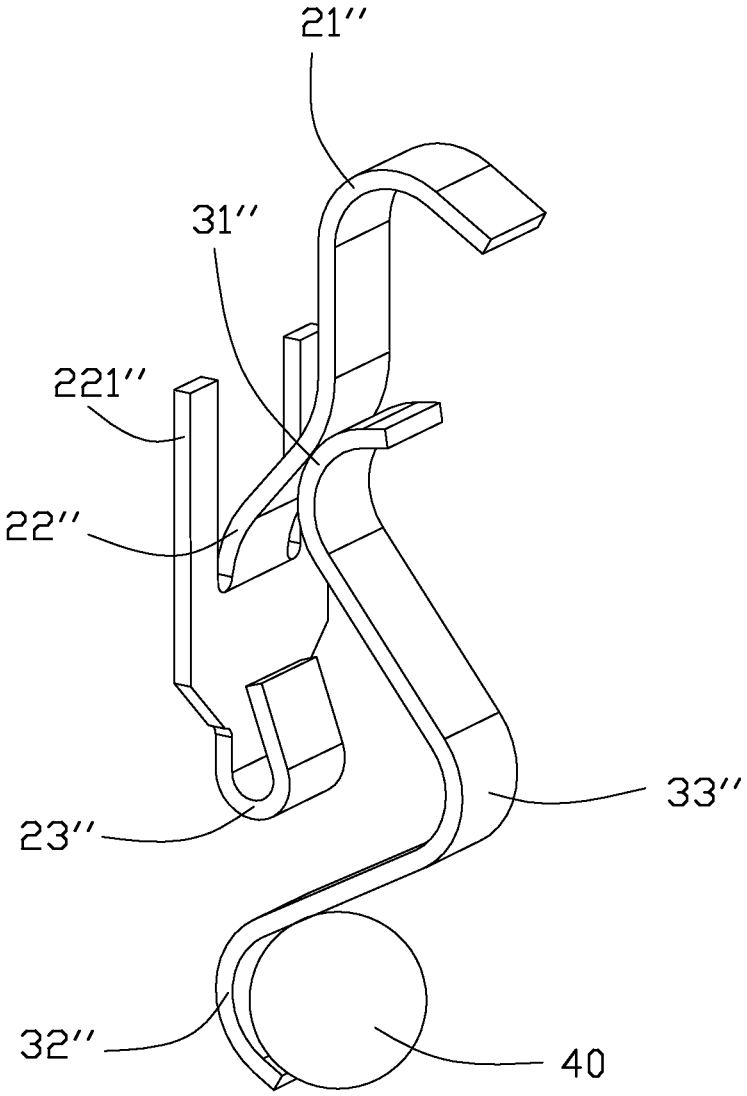
FIG. 11 is a perspective view of the contact halves shown in FIG. 8.

Referring to FIGS. 8 and 11, the upper contact half 20" has a first curve section 21" extending out of a top surface 101" of the insulative housing 10" at a free end thereof, a second curve section 22" extending from the first curve section 21", and a third curve section 23" at a bottom end thereof. The upper contact half 20" is formed by bending operations. The second curve section 22" further has a straight portion 221" connected with the third curve section 23" and resting on an inner surface 110" of the passageway 11" so that the second curve section 22" slides along the inner surface 110".

The lower contact half 30" has a first curve section 31" contacting with the upper contact half 20", an elastic/third curve section 33" connected with the first curve section 31" and a second curve section 32" at a bottom end thereof and extending out of a bottom surface 102" of the insulative housing 10". The lower contact half 30" is formed by bending operations, and the first curve section 31", the elastic section 33" and the second curve section 32" thereof are arranged end-to-end, and the elastic section 33" contacts with another inner surface 112" of the passageway 11". The first and second curve sections 31", 32" at upper and lower ends of the lower contact half 30" project to the inner surface 110" of the passageway 11" and open towards the inner surface 112". The third curve section 33" in the middle projects to the inner surface 112" and opens towards the inner surface 110".

The third curve section 23" of the upper contact half 20" is a closed looped end and the first curve section 31" of the lower contact half 30" is provided a guiding surface for the third curve section 23" of the upper contact half 20" inserted downwardly and passing by the first curve section 31" of the lower contact half 30". A solder ball 40 is clipped by the second curve section 32" and the insulative housing 10". The insulative housing 10" defines a slant surface 113" under the elastic section 33" to support the elastic section 33" of the lower contact half 30".

Figure 9:
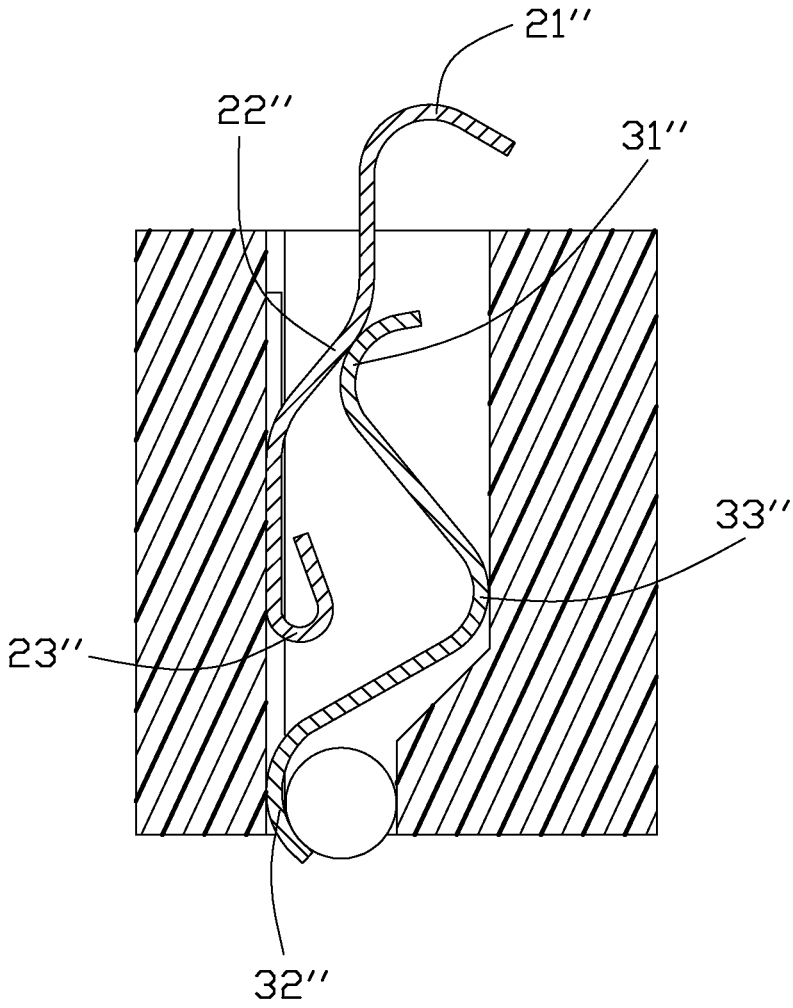
FIG. 9 is another cross-sectional view of the electrical connector shown in FIG. 8 while the contact halves are pressed.
Figure 10:
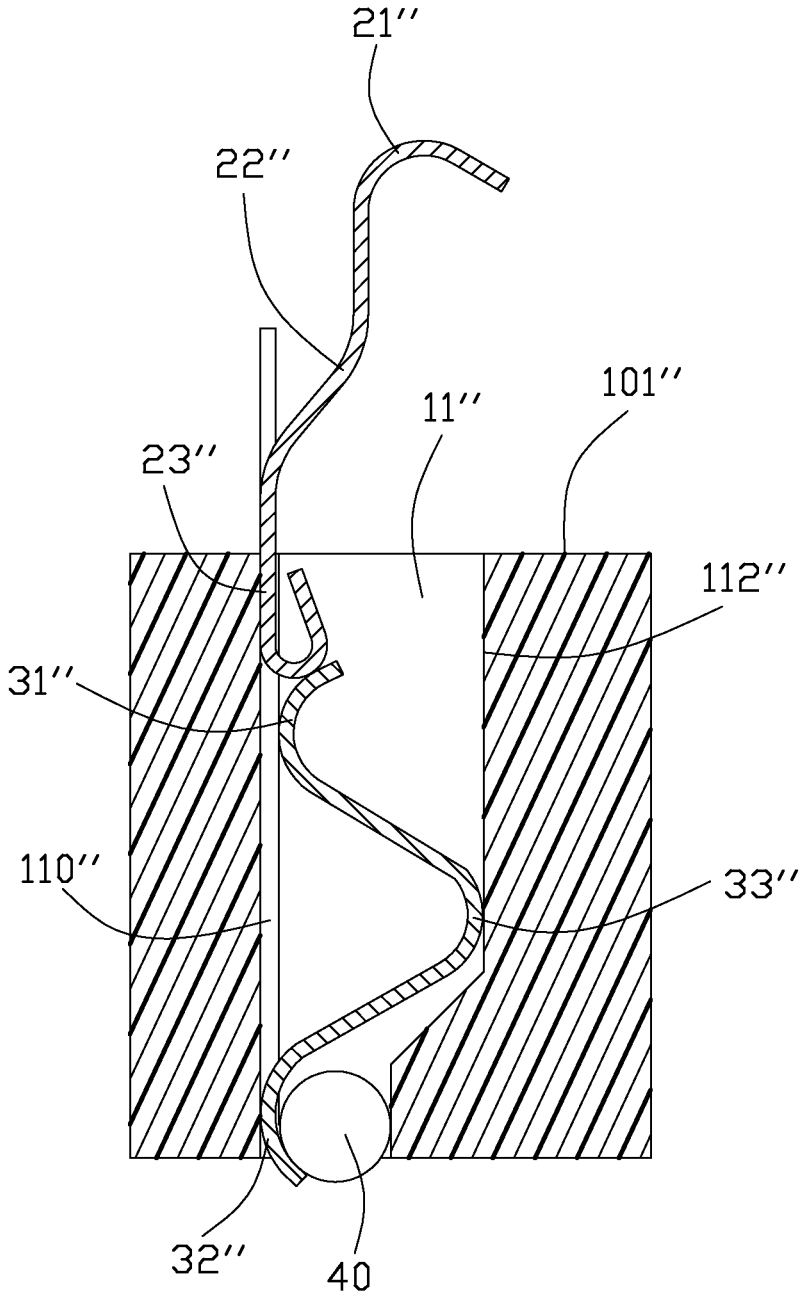
FIG. 10 is a sketch view showing how the contact halves of FIG. 8 are attached.

As shown in FIG. 9, as the CPU (not shown) moves downward, an external force is applied to the first curve section 21" of the upper contact half 20", the upper contact half 20" moves downward while maintaining the interface with the lower contact half 30". The lower contact half 30" applies a force on a surface of the second curve section 22" of the upper contact half 20". As the upper contact half 20" moves downward, it wipes against the lower contact half 30" thereby creating a reaction force and causes displacement in the low contact half 30". Therefore, both the upper and lower contact halves 20", 30" are deflectable in vertical and transverse directions.

More deflection occurs on the lower contact half 30" as it spreads open, and the arc radius/angle of the elastic section 33" increases as it moves along the angled surface of the second curve section 22" of the upper contact half 20". Then once the force is removed from the upper contact half 20", the reaction force of the lower contact half 30" will lend itself to push the top contact half 20" up to its free-state condition.

The lower contact half 30" is loosely contained within the insulative housing 10" by low frictional forces. The passageway 11" of the insulative housing 10" is slightly smaller than the width of the lower contact half 30", thus the lower contact half 30" is wedged in the insulative housing 10". Upon surface mount to a circuit board (not shown), the lower contact half 30" becomes more secured in the assembly.

The upper contact half 20" is a closed looped end to allow for rounded surface to aid in the insertion process. The first curve section 31" of the lower contact half 30" is provided a guiding surface for the third curve section 23" of the upper contact 20" inserted downwardly and passing by the first curve section 31" of the lower contact half 30". As the upper contact half 20" is pushed into the assembly, its rounded tail forces the lower contact half 30" to displace, as basically shown FIG. 10. Once the looped end pass by the first curve section 31", the lower contact half 30" makes contact with the surface of the second curve section 22" of the upper contact half 20". In the same time, the upper contact half 20" is retained from being pulled out.

The upper contact half 20" is provided with a straight portion 221" which are guides/flattened features and help carry the upper contact half 20" and enable it to be inserted into the assembly. Once inserted, a carrier strip of the upper contact half 20" can be broken off by using the common method of bending in opposing directions. The flattened features also act as a guide for the upper contact as it moves up and down through its range of motion when used. Alternatively, the upper contact portion could be changed such that its tip is extended fully below the top surface 101" of the insulative housing 10".

The present invention relates to a two-piece, dual compliant contact design. At least one contact half includes three curve sections connected end-to-end and the other contact half includes at least two curve sections at two free ends thereof. The two contact halves are adapted to deflect in vertical and transverse directions and wiping each other when an external force is exerted thereon. Typical contact design solutions have many stamping and forming operations which increase the complexity of the design. Manufacturing limits also restrict the size and the pitch which the typical contact solutions can achieve. This two contact pieces design simplifies the number of bending operations when compared with typical contact designs.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector comprising:

an insulative housing having a plurality of passageways extending therethrough; and a plurality of contacts restricted in the insulative housing and each including an upper contact half sliding in the passageways and a lower contact half supporting the upper contact half, said upper contact half having a first curve section extending out of the insulative housing at a free end thereof, a second curve section extending from the first curve section, and a third curve section at a bottom end thereof; said lower contact half having a first curve section contacting with the upper contact half, an elastic section connected with the first curve section and a second curve section at bottom end thereof; wherein when an external force is applied to the first curve section of the upper contact half, the upper and lower contact halves both are deflectable; wherein the first curve section of the lower contact half is capable of wiping the second curve section of the upper contact half.

2. The electrical connector as claimed in claim 1, wherein a solder ball is clipped by the second curve section of the lower contact half and the insulative housing.

3. The electrical connector as claimed in claim 1, wherein the upper contact half is formed by bending operations, and wherein the first curve section, the second curve section and the third curve section thereof are arranged end-to-end; and the second curve section of the upper contact half slides along an inner surface of the passageway.

4. The electrical connector as claimed in claim 1, wherein the lower contact half is formed by bending operations, and the first curve section, the elastic section and the second curve section thereof are arranged end-to-end, and the elastic section contacts with an inner surface of the passageway.

5. The electrical connector as claimed in claim 4, wherein the second curve section of the upper contact half further has a straight portion connected with the third curve section, and wherein the straight portion resting on an inner surface of the passageway.

6. The electrical connector as claimed in claim 1, wherein the passageway of the insulative housing is slightly smaller than the lower contact half, and the lower contact half is wedged in the insulative housing.

7. The electrical connector as claimed in claim 1, wherein the insulative housing defines a slant surface under the elastic section to support the elastic section of the lower contact half.

8. The electrical connector as claimed in claim 1, wherein the second curve section of the upper contact half is combined with a more rigid material than the first curve section of the lower contact half.

9. The electrical connector as claimed in claim 1, wherein the third curve section of the upper contact half is a closed looped end, and the first curve section of the lower contact half is provided a guiding surface for the third curve section inserted downwardly and passing by the first curve section of the lower contact half.

10. An electrical connector comprising:

an insulative housing having a plurality of passageways extending therethrough; and two contact halves received in each passageway and coupled with each other, one contact half including three curve sections connected end-to-end and the other contact half including at least two curve sections at two free ends thereof, said two contact halves adapted to deflect in vertical and transverse directions and wiping each other when an external force is exerted thereon; wherein said one contact half projects out of the insulative housing and a solder ball is secured to said the other contact half.

11. The electrical connector as claimed in claim 10, wherein one curve section of said three curve sections in the middle projects to one inner surface of the passageway, and the other two curve sections at upper and lower ends of said three curve sections bending upwardly and downwardly, respectively and open opposite to each other.

12. The electrical connector as claimed in claim 10, wherein one curve section of said three curve sections in the middle projects to one inner surface of the passageway, and the other two curve sections at upper and lower ends of said three curve sections project to another inner surface opposite to said one inner surface.

13. The electrical connector as claimed in claim 10, wherein said the other contact half further comprising a straight portion located between the two curve sections thereof, and wherein said straight portion is capable of contacting with an inner surface of the insulative housing.

14. An electrical connector for use with an electronic package and a printed circuit board, comprising:

an insulative housing defining opposite upper and bottom surfaces with at least one passageways extending therethrough in the vertical direction;

a contact set disposed in the passageway, said contact set including differently configured upper and lower pieces respectively retained to upper and lower regions in said passageway, said lower piece essentially immoveable in the vertical direction with a bottom end securing thereto a solder ball exposed beyond the bottom surface for soldering to the printed circuit board, said upper piece essentially up and down moveable in the vertical direction with an upper curved contacting section extending beyond the upper surface for contacting a corresponding pad of the electronic package; wherein said lower piece defines a lower abutment section around an upper free end thereof, said upper piece defines an upper abutment section extending in an oblique direction and upwardly urged by said lower abutment section under condition that during downward movement of the electronic package, loaded abutment between the upper abutment section and the lower abutment section starts proximate a corresponding side wall of the passageway and moves toward a center of said passageway gradually so as to enhance a combined restoration force derived from both the upper piece and the lower piece.

15. The electrical connector as claimed in claim 14, wherein at least one of said upper abutment section and side lower abutment section defines a curved configuration in confrontation with the other.

16. The electrical connector as claimed in claim 14, wherein a contacting point of the upper contacting section is essentially located closer to the center of the passageway in a top view than to the corresponding side wall which the upper piece leans against.

17. The electrical connector as claimed in claim 14, wherein deformations of said upper piece and said lower piece are different from each other, including configurations and restoration forces involved therewith.

* * * * *